United States Patent [19]

Skaalen et al.

[11] 4,253,547

[45] Mar. 3, 1981

[54] PORTABLE PERSONNEL PLATFORM AND LADDER

[75] Inventors: Clifford I. Skaalen, Oxnard; Arthur B. Rausch, Port Hueneme, both of Calif.

[73] Assignee: The United States of America as represented by the Secretary of the Navy, Washington, D.C.

[21] Appl. No.: 134,833

[22] Filed: Mar. 28, 1980

[51] Int. Cl.[3] ..... E06C 1/393; E06C 1/56

[52] U.S. Cl. ..... 182/115; 182/152; 182/196; 182/63

[58] Field of Search ..... 182/115, 152, 196, 197, 182/198, 113, 106, 222, 63

[56] References Cited

U.S. PATENT DOCUMENTS

| | | | |
|---|---|---|---|
| 260,627 | 7/1882 | Townsend | 182/196 |
| 2,979,154 | 4/1961 | Bell | 182/196 |
| 3,480,107 | 11/1969 | Goodhue | 182/115 |
| 3,777,846 | 12/1973 | Josephson | 182/196 |
| 3,961,686 | 6/1976 | Starkey | 182/196 |
| 4,022,292 | 5/1977 | Van Gompel | 182/196 |
| 4,139,080 | 2/1979 | Wells | 182/115 |

*Primary Examiner*—Reinaldo P. Machado

*Attorney, Agent, or Firm*—Richard S. Sciascia; J. M. St. Amand

[57] ABSTRACT

A portable personnel platform and ladder for use with elevated piers and floating decks has one end of a compression framework pivotally attached to a rope ladder supporting platform which extends over the pier's edge; adjustable wire backstays which provide cantilever strength connect the opposite end of the compression framework to the upper end of railings on the ladder supporting platform. The opposite end of the compression framework is adapted to have weight added thereto or to be secured to the pier deck. The length of the compression framework is such that considerable leverage is provided to support the weight of several people climbing on the rope ladder attached to the supporting platform while using much less counterbalancing force on the opposite end of the compression framework.

11 Claims, 4 Drawing Figures

PORTABLE PERSONNEL PLATFORM AND LADDER

BACKGROUND OF THE INVENTION

The present invention relates to ladders and more particularly to a portable platform having a detachable ladder.

During construction of piers or in movement of personnel from boats to docks, etc., personnel are required to move between elevated decks and floating platforms separated some distance in elevation, perhaps 15 to 20 feet or more. Several prior methods have been used including step ladders, wood towers, scaffolds and various detachable platforms, all of which have proved to be dangerous in their use because of the moving platforms and/or lack of attachment points to secure the ladders, towers, or scaffolds.

The present invention provides a safe and convenient portable platform and ladder for personnel to climb between elevated and floating platforms separated with varying vertical heights. The vertical height can vary during the time an individual is climing the ladder such as in cases where a floating platform moves upward toward or downward from the elevated platform. The instant device has special utility in other areas as well, such as in rescue or in construction where a lightweight, portable, variable length ladder is required.

SUMMARY OF THE INVENTION

The invention consists of a small platform pivotally attached to one end of a compression framework which lays on the surface of a pier or deck, etc. Guard rails are secured to and extend upward from the small platform which is constructed to support a flexible ladder suspended from beneath while the small platform extends over the edge of a deck. Wire rope backstays are connected between the tops of the guard rails and the opposite end of the compression framework to provide cantilever strength; the length of the compression framework is such as to provide considerable leverage to support the weight of several persons climbing the ladder with a much smaller counter ballancing force at the opposite end thereof. The opposite end of the compression framework is not required to be secured by clamps, rope, etc., to the pier, but merely the weight of one person or object of similar weight can be sufficient to support several men climbing on the suspended ladder.

DESCRIPTION OF THE PREFERRED EMBODIMENTS

Figure 1:
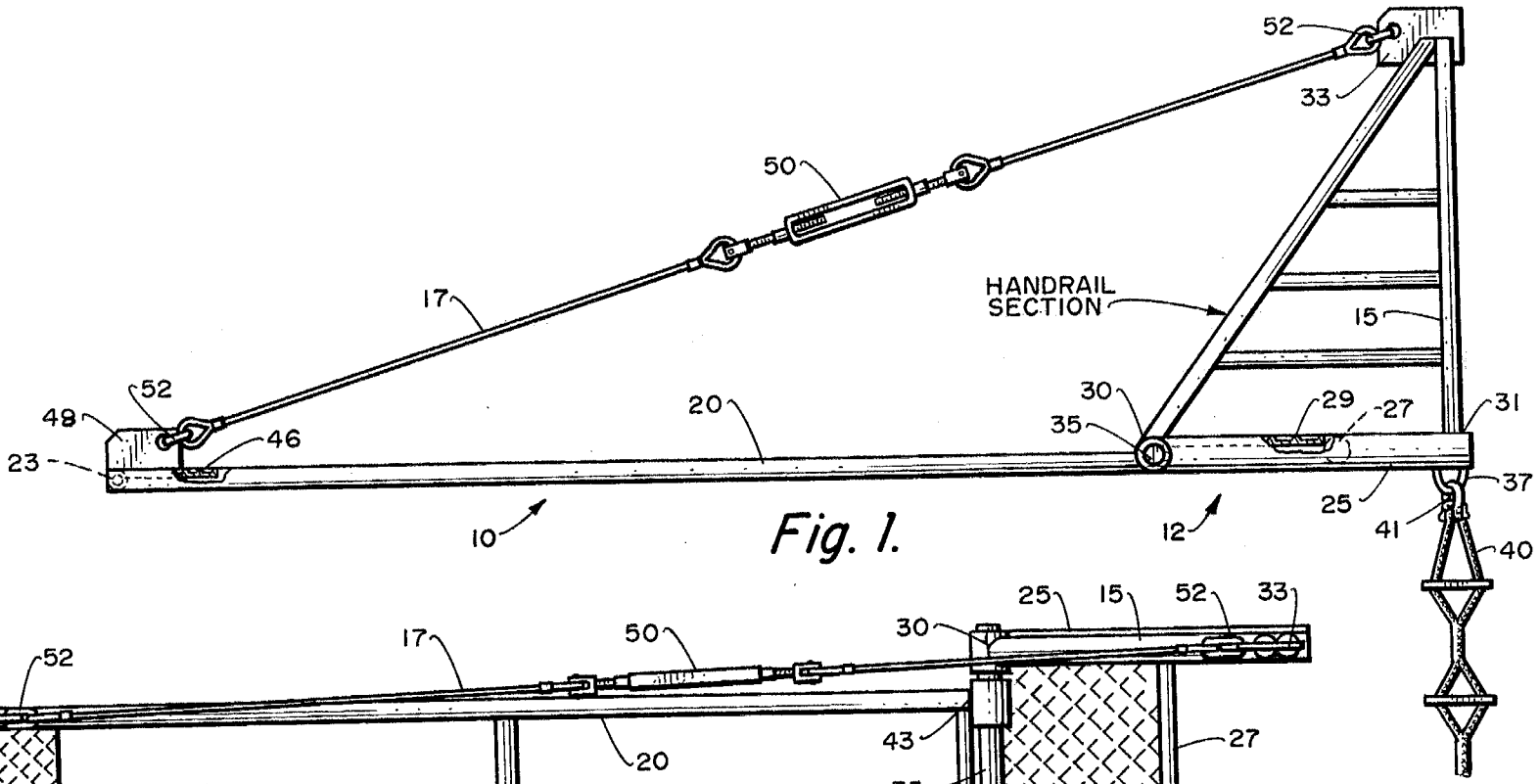
FIG. 1 is a side view of the portable platform and ladder assembly.

As shown in the drawings, the portable platform/ladder assembly, consists principally of a compression framework 10, a ladder supporting platform 12 with a flexible rope-type ladder, railing sections 15, and backstays 17.

Compression framework 10 is preferably constructed from lightweight metal tubing, such as aluminum, and is comprised of two elongated compression members 20, as particularly shown in FIG. 1, and several cross members 21, 22 and 23.

Figure 2:
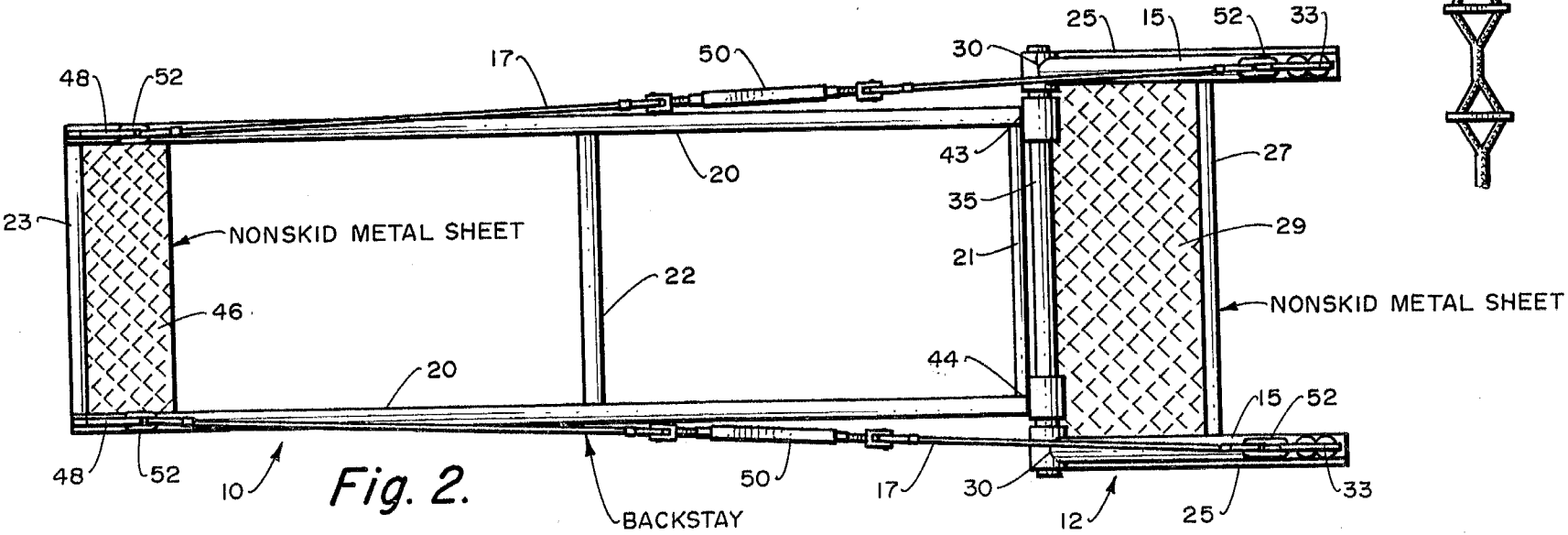
FIG. 2 is a top view of the assembly shown in FIG. 1.

The ladder supporting platform 12 comprises a pair of heavierweight tubular side members 25 having one or more tubular cross members 27 connecting the side members together and an expanded metal or non-skid metal platform sheet 29 attached to side members 25 and cross members 27. Metal platform sheet 29 can be of any desired length, and can be less than the length of side members 25, as shown in FIGS. 1 and 2, or nearly full length as shown in FIG. 3.

Figure 3:
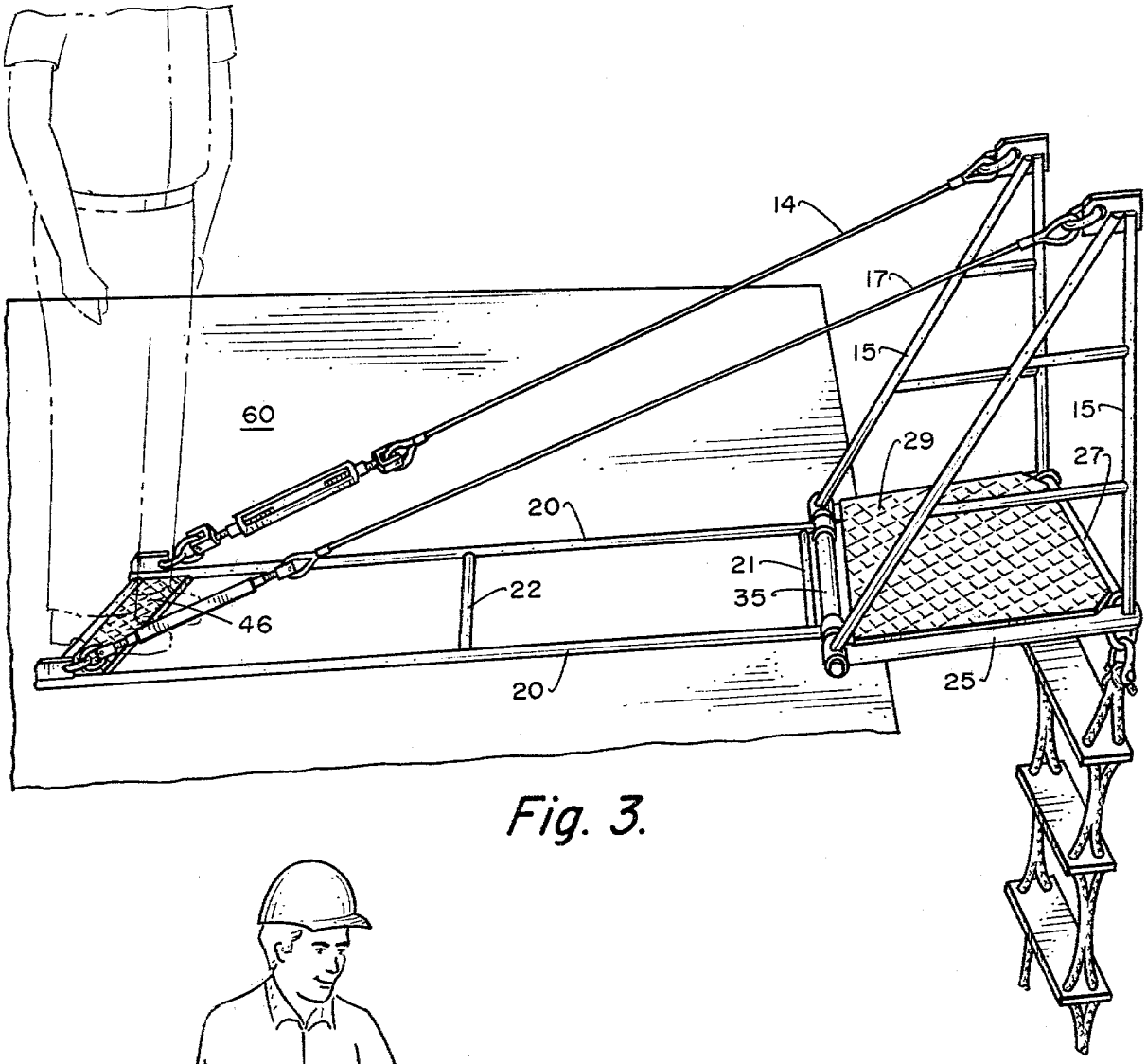
FIG. 3 is a perspective view showing the assembly of FIGS. 1 and 2 in use on the deck of a pier.

Railing sections 15 are constructed of lightweight metal tubular members to form a triangular framework as best shown in FIGS. 1 and 3. The base of each triangular framework is securely fastened to a platform side member 25 at points 30 and 31. The top of each railing section is provided with a shackle attaching member 33.

Figure 4:
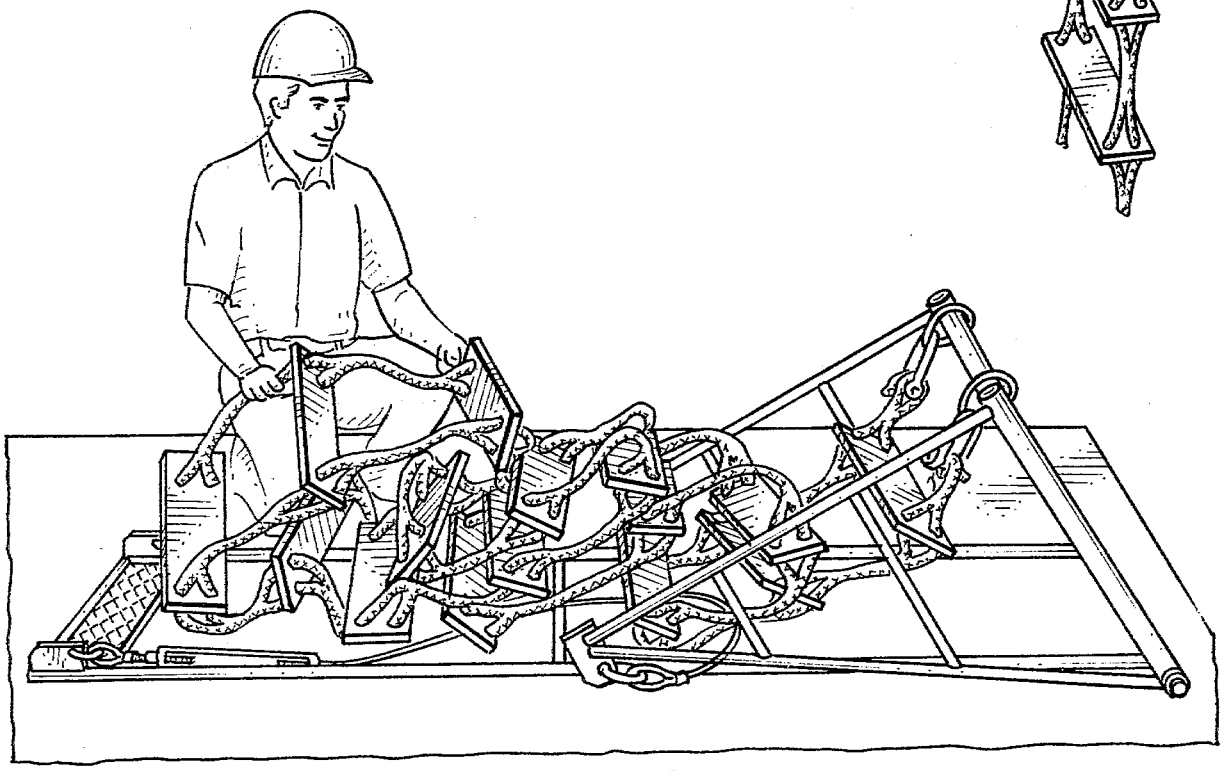
FIG. 4 shows the portable platform and ladder in a carry mode.

Hinge 35 pivotally connects ladder supporting platform 12 to compression framework 10. Ladder attachments 37 connected to each of the platform side members 25 allows a flexible ladder 40 to be attached to platform 12 with shackles 41 or other suitable means. A preferred ladder is made of rope with wooden steps as shown in FIGS. 1, 3 and 4.

One end of compression framework 10 is pivotally connected to hinge 35 at points 43 and 44. The opposite end of the compression framework is preferably provided with a nonskid metal sheet 46 on which a person can stand or a weight placed.

A second pair of shackle attaching members 48 are provided at opposite sides of the compression framework adjacent metal sheet 46, as shown in the drawings.

An adjustable backstay 17, having a turnbuckle 50 is connected between respective shackle attaching members 33 and 48 on each side of the assembly, as shown in FIGS. 1 and 2, using shackles 52 or other suitable connectors.

The ladder and platform can support several men at one time, e.g., up to approximately 600 pounds weight.

The opposite end 23 of compression framework 10 can be tied down or secured to the pier deck with rope or other means if desired and if convenient tie down points are available on the pier deck. However, as previously indicated, a weight can be placed or a person can stand on metal platform 46 and support three men climbing the ladder. Compression members 20 of framework 10 together with railings 15 and backstay members 17 develop a cantilever strength which provides considerable leverage whereby one person can support several persons climbing the ladder. The length of the compression framework substantially determines the amount of leverage obtained. The compression framework 10 should be approximately four times the length of platform members 25 for one man sitting or standing on platform 46 to support three men climbing the ladder. By varying the length of the compression framework this ratio can be varied. Heavier weight placed on platform 46 can also increase the amount of leverage force and thus support more persons on the ladder assuming the mechanical strength of the assembly is sufficient.

The platform and ladder is normally hand carried to the point of installation in the folded carrying mode, as shown in FIG. 4. Sufficient weight (e.g., a person or heavy object) is placed on end platform 46, as shown in FIG. 3, or end 23 is otherwise secured in any suitable manner to the pier deck 60. The ladder support platform 12 is then folded into the open position and adjusted using the backstay turnbuckles. The ladder 40 which is attached to platform 12 is then launched as shown in FIG. 3.

The portable personnel platform and ladder has an advantage in all situations where ladder flexibility is required because of variable climbing distances during actual climbing. The platform 12 provides an easy transition from the ladder to the deck. Any length ladder can be used with the platform assembly, and flexible ladder that is longer than required will not encumber the operation of this device. The platform and ladder are lightweight and portable and for easy movement from one location to another.

The platform and ladder assembly can be constructed of a variety of materials. The length and width of the platform assembly and/or ladder will depend on the predominant use. For example, the distance from the platform to the tie down can be changed to provide more or less climbing capability with a given weight on the tie down section of the platform assembly. In this respect, this device can be used anywhere without particular attention to tie downs since a weight or person placed on the opposite end will be sufficient to hold the assembly in place for use by several persons climbing the ladder.

Obviously, many modifications and variations of the present invention are possible in the light of the above teachings. It is therefore to be understood that within the scope of the appended claims the invention may be practiced otherwise than as specifically described.

What is claimed is:

1. A portable personnel platform and ladder assembly for use on decks of piers, docks and ships, comprising:

a. a ladder supporting platform means operable to extend over the edge of a deck;

b. said ladder supporting platform means having a forward and a rearward edge, two opposite side members and a flat platform section mounted therebetween;

c. a compression framework having one end thereof pivotally attached to the forward edge of said ladder supporting framework means;

d. said ladder supporting platform means being operable to be folded over said compression framework where pivotally attached thereto;

e. ladder attachment means mounted on said ladder supporting platform means toward the rearward edge thereof;

f. ladder means connected to said ladder attachment means and extending downward therefrom;

g. respective railing sections mounted on and extending upward from opposite sides of said ladder supporting means;

h. a pair of backstay means between the tops of said respective railing sections and the opposite end of said compression framework on respective side thereof; said backstay means being operable together with said compression framework and said railing sections to form trusses which develop cantilever strength; the length of said trusses being varied by changing the length of said compression framework;

i. means at the opposite end of said compression framework for applying a holding force which together with the length of said trusses is operable to create sufficient leverage to support a downward force on said ladder means and said ladder supporting platform means at least several times greater than said holding force.

2. An assembly as in claim 1 wherein said backstays are adjustable.

3. As assembly as in claim 1 wherein said means at the opposite end of said compression framework for applying a holding fore comprises a platform on which weight is placed.

4. An assembly as in claim 1 wherein said compression framework and said railing sections are of lightweight tubular metal.

5. An assembly as in claim 1 wherein said ladder is flexible.

6. As assembly as in claim 5 wherein said flexible ladder is of rope with wooden steps.

7. An assembly as in claim 1 wherein said backstays a are of wire rope with turnbuckles for adjustment.

8. An assembly as in claim 1 wherein the flat platform section of said ladder supporting platform means extends rearward only halfway from said forward edge.

9. An assembly as in claim 1 wherein said two opposite side members of said ladder supporting platform means are heavy tubular members having said railing sections and ladder attachment means mounted thereon.

10. An assembly as in claim 1 wherein said compression framework comprises a pair of elongated side members and a plurality of cross members; said elongated side members operable to take force in compression along the length thereof when said assembly is in use.

11. An assembly as in claim 1 wherein a tie down means is provided at the opposite end of said compression framework.

* * * * *